US005717977A

United States Patent [19]

Suzuki et al.

[11] Patent Number: 5,717,977

[45] Date of Patent: Feb. 10, 1998

[54] IMAGE FORMING APPARATUS WITH CONTROL BASED ON RECORDING MATERIAL TYPE

[75] Inventors: Akio Suzuki, Tokyo; Toshiyuki Kitamura, Yokohama, both of Japan

[73] Assignee: Canon Kabushiki Kaisha, Tokyo, Japan

[21] Appl. No.: 811,452

[22] Filed: Mar. 3, 1997

Related U.S. Application Data

[63] Continuation of Ser. No. 413,892, Mar. 30, 1995, abandoned.

[30] Foreign Application Priority Data

Apr. 1, 1994 [JP] Japan ..... 6-064906

[51] Int. Cl.[6] ..... G03G 15/00

[52] U.S. Cl. ..... 399/45; 399/81; 399/389

[58] Field of Search ..... 399/45, 75, 81, 399/82, 83, 361, 381, 389, 391

[56] References Cited

U.S. PATENT DOCUMENTS 4,520,263 5/1985 Kitamura .
4,579,446 4/1986 Fujino et al. .
4,685,797 8/1987 Ito .
5,136,341 8/1992 Takemura et al. .
5,296,903 3/1994 Suzuki et al. .
5,424,821 6/1995 Sampath .
5,459,580 10/1995 Suzuki .

FOREIGN PATENT DOCUMENTS 2-108073 4/1990 Japan .

*Primary Examiner*—Sandra L. Brase
*Attorney, Agent, or Firm*—Fitzpatrick, Cella, Harper & Scinto

[57] ABSTRACT

When a manual paper feed key 126 is depressed on a set picture plane after a paper selection key was depressed, set picture planes of the size and material are displayed. When a paper feed stage is designated by a key 142 on a set picture plane of the OHP sheet feed stage registration, the designated paper feed stage is set to the cassette for OHP sheets. Thus, the material of the recording member is set at a high operating efficiency every manual paper feed stage and paper feed stage.

20 Claims, 12 Drawing Sheets

IMAGE FORMING APPARATUS WITH CONTROL BASED ON RECORDING MATERIAL TYPE

This application is a continuation of application Ser. No. 08/413,892 filed Mar. 30, 1995 now abandoned.

BACKGROUND OF THE INVENTION

1. Field of the Invention

The invention relates to the setting of a material of a recording member in an image forming apparatus.

2. Related Background Art

Hitherto, there is an image forming apparatus having a manual paper feeding function. An OHP sheet (transparency) or the like is inserted into a manual paper feeding port and a manual paper feed is performed.

In case of using a recording member such as an OHP sheet or the like different from a normal copy paper, it is preferable to make image forming conditions different from ordinary conditions. However, since the image forming conditions hitherto have to be adjusted independently of the setting of the manual paper feeding mode, an operability is bad.

In the case where the user wants to use a large quantity of OHP sheets, the OHP sheets are generally enclosed in a cassette. However, since the apparatus doesn't identify whether the sheets in the cassette are the normal copy papers or OHP sheets, the recording is performed for both of the normal copy paper and the OHP sheet under the same conditions.

Even when the image forming conditions are separately adjusted, so long as the cassette enclosing the normal copy papers is selected, the image forming conditions have to be returned to the original conditions each time of such a selection, so that an operability is deteriorated.

SUMMARY OF THE INVENTION

It is an object of the invention to provide an image forming apparatus which can solve the drawbacks as mentioned above.

Another object of the invention is to provide an image forming apparatus which can designate a material of a recording member at a high operability in a manual paper feeding mode.

Still another object of the invention is to provide an image forming apparatus which can set a material of a recording member enclosed in enclosing means and can form an image suitable for the material.

Further another object of the invention is to provide an image forming apparatus which can inhibit a two-sided copy to a recording member of a predetermined material and can prevent that an unsightly image is formed.

The above and other objects and features of the present invention will become apparent from the following detailed description and the appended claims with reference to the accompanying drawings.

DETAILED DESCRIPTION OF THE PREFERRED EMBODIMENT

An embodiment of the present invention will now be described hereinbelow with reference to the drawings.

Figure 1:
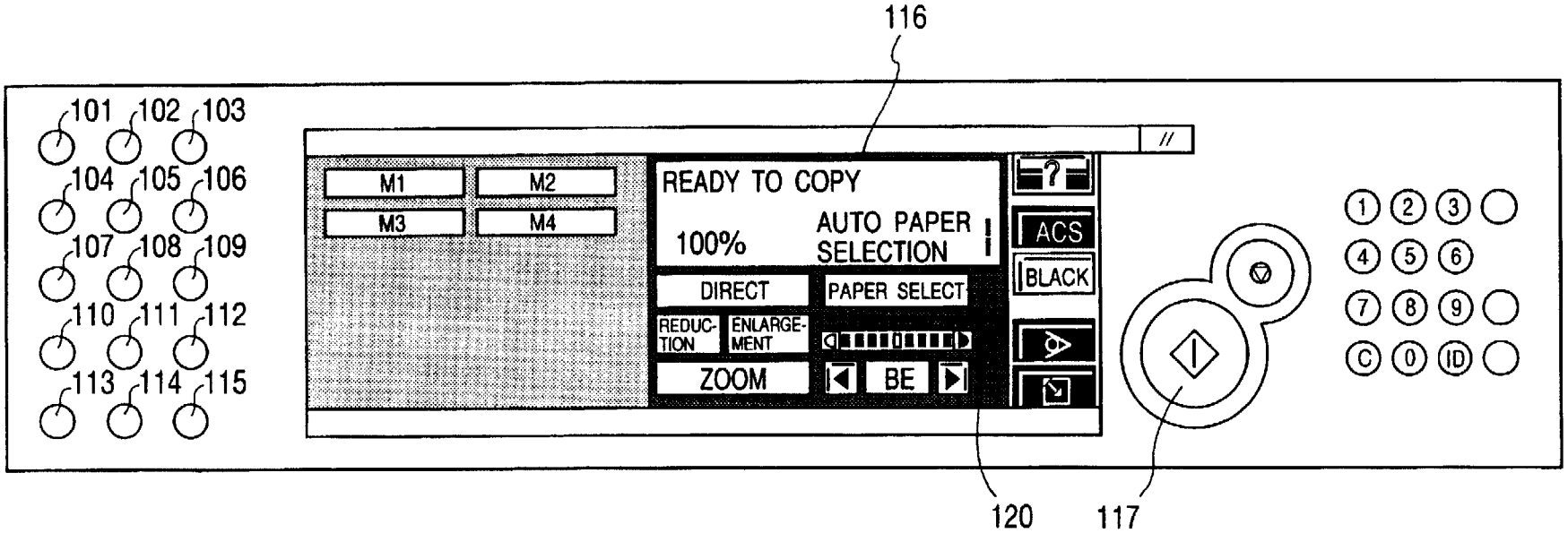
FIG. 1 is a diagram showing an operating section of an image forming apparatus.

FIG. 1 is a diagram showing an operation display section of an image forming apparatus to which the invention can be applied.

Reference numerals 101 to 115 denote keys for setting various copy modes. Each key has therein an LED which is lit on when a mode corresponding to the depressed key is set. Reference numeral 116 denotes a liquid crystal display section having a touch panel in an upper portion. A soft key can be formed on a picture plane.

Figure 2:
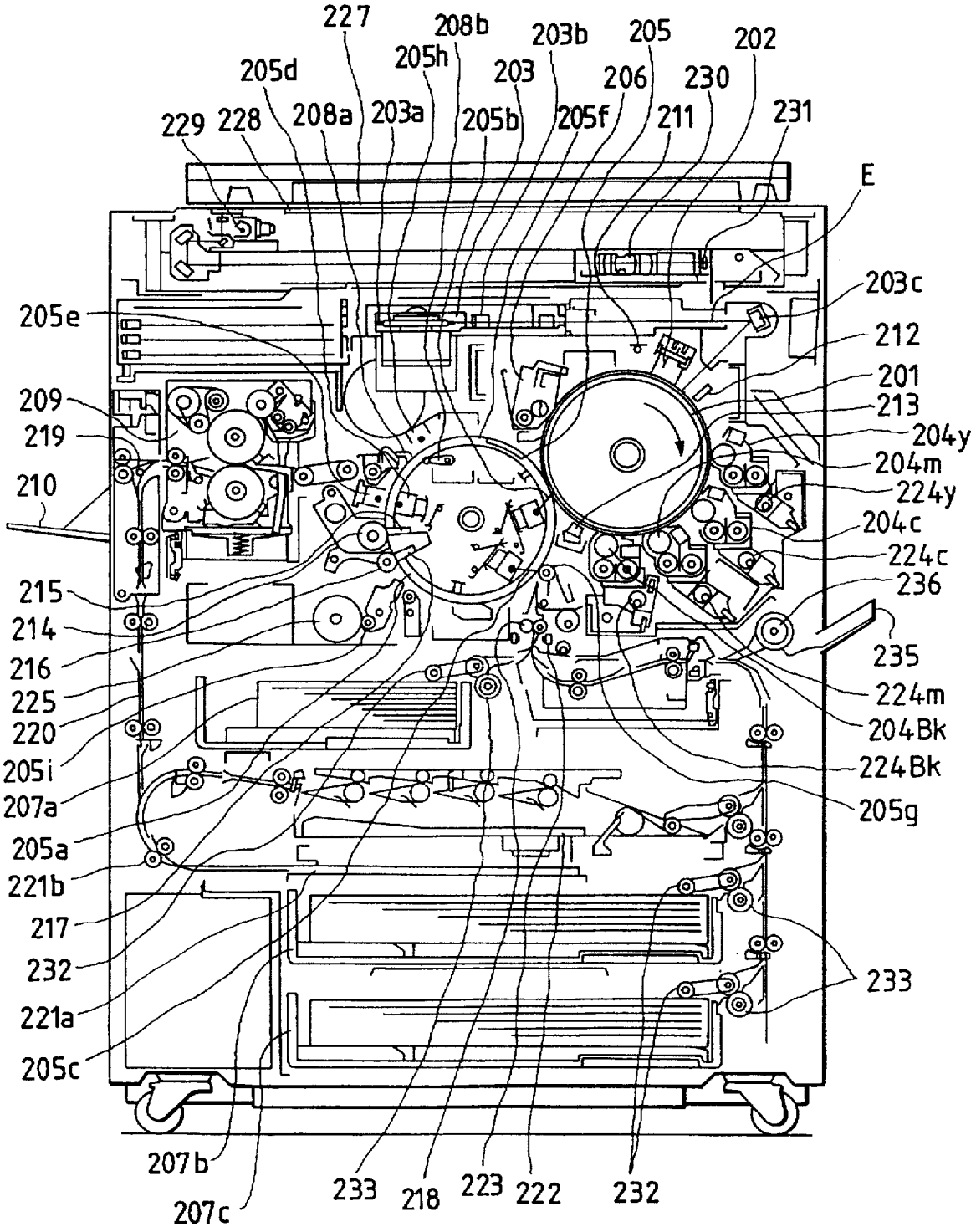
FIG. 2 is a cross sectional view of the image forming apparatus.

FIG. 2 is a schematic cross sectional view of the image forming apparatus.

The apparatus has a digital color image reader section in an upper portion and a digital color image printer in a lower portion.

In the reader section, by putting an original 227 onto an original support plate glass 228 and exposing and scanning the original by an exposure lamp 229, a reflected light image from the original 227 is converged onto a full-color sensor 231 through a lens 230 and a color separation image signal is derived. The color separation image signal passes through an amplifying circuit (not shown) and is processed by a video processing unit (not shown). The processed signal is supplied to the printer section.

In the printer section, a photosensitive drum 201 as an image holding member is held so as to be rotatable in the direction of an arrow. A pre-exposure lamp 211, a corona charging device 202, a laser exposure optical system 203, a potential sensor 212, four developing devices 204*y*, 204*c*, 204*m*, and 204B*k* containing developing agents of different colors, light amount detecting means 213, a transfer apparatus 205, and a cleaning device 206 are arranged around the photosensitive drum 201.

In the laser exposure optical system 203, an image signal from the reader section is converted to a light signal by a laser output section (not shown). The converted laser beam is reflected by a polygon mirror 203*a* and passes through a lens 203*b* and a mirror 203*c* and is irradiated onto the surface of the photosensitive drum 201.

When an image is formed by the printer section, the photosensitive drum 201 is rotated in the direction shown by an arrow and the surface of the drum 201 is discharged by the pre-exposure lamp 211. After that, the photosensitive drum 201 is uniformly charged by the charging device 202. A light image E is irradiated every separation color, thereby forming a latent image.

Subsequently, a predetermined developing device is made operative, the latent image on the photosensitive drum 201 is developed, and a toner image is formed on the photosensitive drum 201. Either one of the developing devices is alternatively made approach the photosensitive drum 201 in accordance with each separation color by the operations of eccentric cams 224*y*, 224*c*, 224*m*, and 224B*k*.

On the other hand, the recording members to which images are transferred are stacked in a recording member cassette and are picked up one by one from the cassette by a pickup roller 232. The recording member is conveyed toward a resist roller 218 by a feed roller 233. When a desired recording member is placed on a manual paper feeding port 235 and a copy start key 117 is depressed, the recording member is conveyed by a conveying roller 236. A sensor 223 of the light transmitting type is arranged just before the resist roller. A size of conveyed recording member can be judged by a time duration during which the light to the sensor is shut off by the recording member. The recording member conveyed to the position of the resist roller is fed to a transfer drum 205*a* by the resist roller at a timing when the head position of the image on the photosensitive drum 201 coincides with the front edge of the recording member. The recording member is electrostatically adsorbed to the transfer drum by an adsorption roller 205*a* and an adsorption charging device 205*c* which serve as opposite electrodes. The toner image on the photosensitive drum is transferred onto the recording member by a transfer charging device 205*b*.

In the embodiment, the transfer apparatus 205 includes: the transfer drum 205*a*; the transfer charging device 205*b*; an adsorption charging device 205*c* for electrostatically adsorbing the recording member; an adsorption roller 205*g* which faces the adsorption charging device 205*c*; an inside charging device 205*d*; and an outside charging device 205*e*. A recording member holding sheet 205*f* made of a dielectric material is cylindrically integratedly suspended in a circumferential opening region of the transfer drum 205*a* axially supported so as to be rotated. As a recording member holding sheet 205*f*, a dielectric material sheet such as a polycarbonate film or the like is used.

As the transfer drum 205*a* is rotated, the toner image on the photosensitive drum is transferred onto the recording member held on the recording member holding sheet 205*f* by the transfer charging device 205*b*.

Toner images of four colors are transferred onto the recording member that is adsorbed to the recording member holding sheet 205*f* as mentioned above, so that a full-color image is formed.

In case of forming a full-color image, when the transfer of the toner image of four colors is finished as mentioned above, the recording member is separated from the transfer drum 205*a* by functions of a separating nail 208*a*, a separation pushing-up roller 208*b*, and a separation charging device 205*h* and is ejected onto a tray 210 through a thermal roller fixing device 209.

On the other hand, after the residual toner on the surface of the photosensitive drum 201 after completion of the transfer of the toner images was cleaned by the cleaning device 206, the drum 201 is again used for the next image forming processes.

In case of forming images on both sides of the recording member, after the recording member was ejected out from the fixing device 209, a conveying path switching guide 219 is soon driven and the recording member is once guided to a reversing path 221*a* through a conveying vertical path 220. After that, a rear edge of the recording member when it was fed is set to a front edge and is delivered out in the direction opposite to the feeding direction by the reverse rotation of a reversing roller 221*b* and is enclosed on an intermediate tray 222. After that, an image is formed onto the other side of the recording member by the image forming processes mentioned above.

To prevent that the toner is scattered and deposited onto the recording member holding sheet 205*f* and the oil is deposited onto the recording member and the like, the cleaning is performed by the functions of a far brush 214 and a backup brush 215 which faces the brush 214 and the functions of an oil removing roller 216 and a backup brush 217 which faces the roller 216. Such a cleaning is performed before or after the image formation and is executed any time a jam (paper jam) occurs.

In the embodiment, by making an eccentric cam 225 operative at a desired timing and making a cam follower 205*i* which is integrated with the transfer drum 205*a*, a gap between the recording member holding sheet 205*f* and the photosensitive drum 201 can be arbitrarily set. For example, in the standby mode or when the power supply is turned off, the transfer drum and the photosensitive drum are away from each other.

A paper selection function as a feature of the embodiment will now be described.

Figure 3:
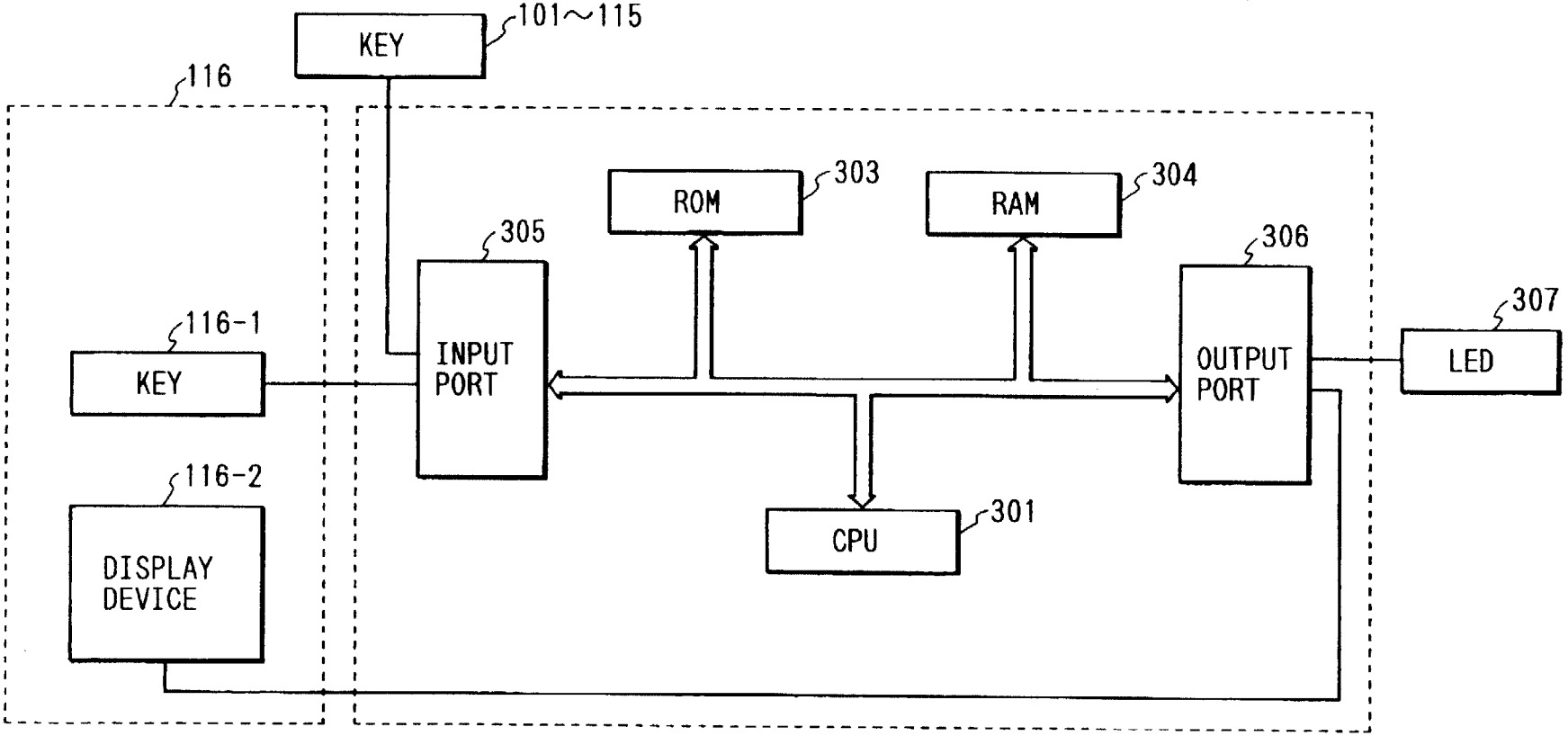
FIG. 3 is a block diagram showing a construction regarding the operating section.

FIG. 3 is a block diagram regarding the operating section of the image forming apparatus. Reference numeral 116-1 denotes a key input section of a touch panel display of the display section 116 in FIG. 1. Reference numeral 116-2 denotes a display device of the key input section and is constructed by a liquid crystal display (LCD). Reference numeral 301 denotes a CPU for controlling a key input and a display; 303 an ROM in which programs for key input and display control and data of various setting picture planes, which will be explained hereinlater, have been stored; 304 an RAM serving as a work area of the CPU 301; 305 an input port to fetch data from the key 116-1; 306 an output port to output display data to the LCD 116-2; and 307 an LED built in each of the keys 101 to 115. The LED is lit on/off in accordance with the on/off operation of the key.

Figure 4:
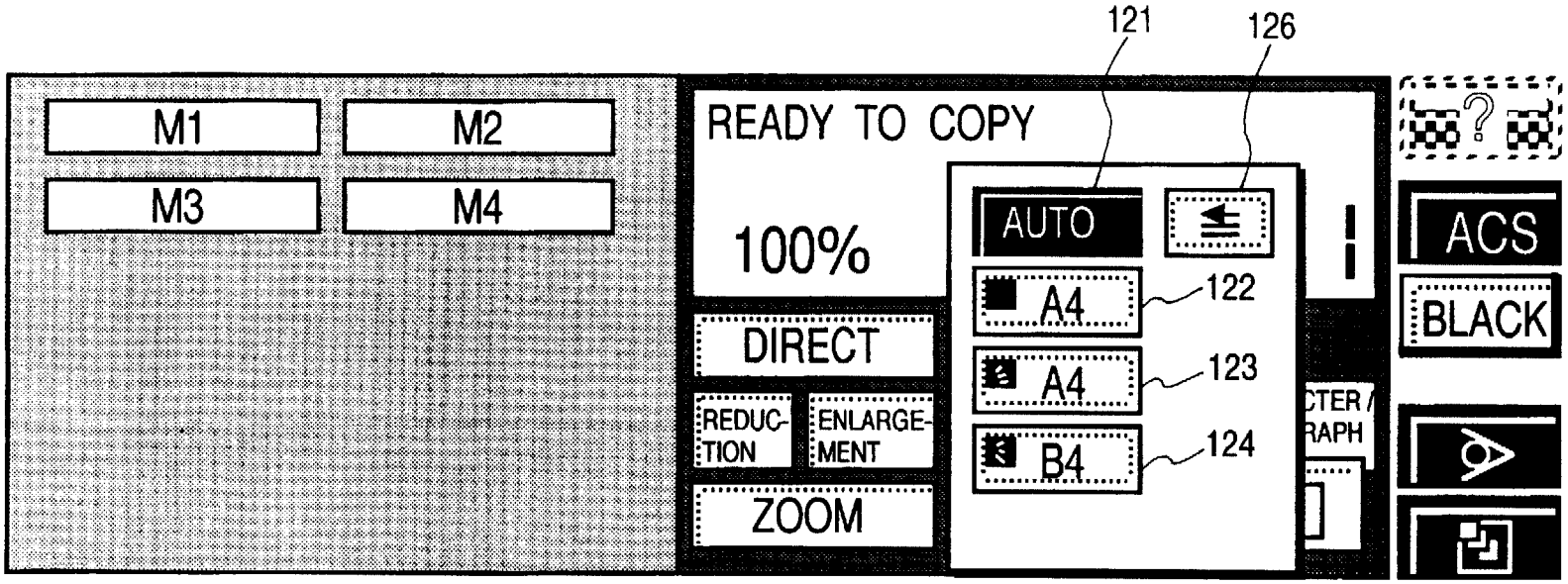
FIG. 4 is a diagram showing a set picture plane after a paper selection key was depressed.

In the embodiment of the invention, when designating a manual paper feeding unit, by depressing a "paper selection" key 120 on the display section 116 in FIG. 1, a picture plane as shown in FIG. 4 is displayed on the liquid crystal display screen and the paper feed stage selected at present is inversely displayed. FIG. 4 shows a state in which an auto paper selection mode is set.

In the picture plane, each paper feed stage can be selected by depressing a desired one of keys 122 to 124 indicative of the paper feed stage to be directly selected. When the operator depresses a key 126 with a manual paper feeding unit mark on the picture plane, a manual paper feeding size designation picture plane as shown in FIG. 5 is displayed.

Figure 6:
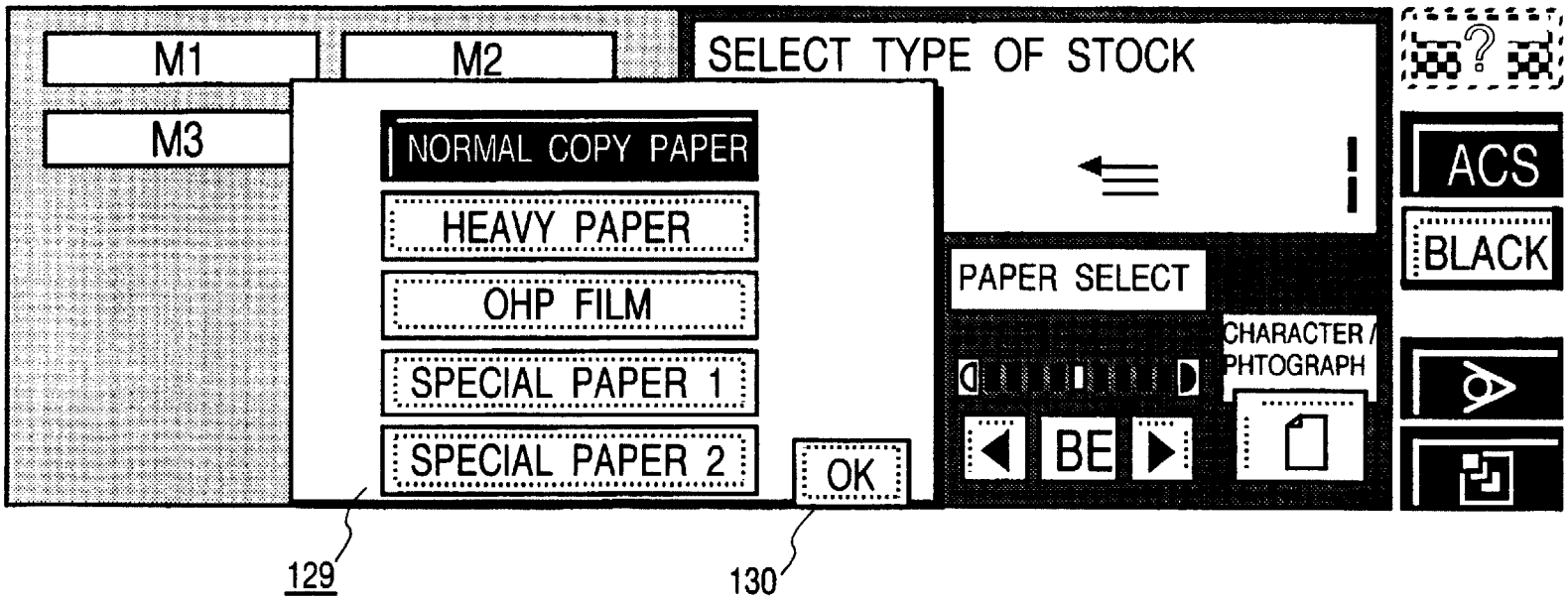
FIG. 6 is a diagram showing a set picture plane after the size of sheet in the manual paper feeding mode was set.
Figure 7:
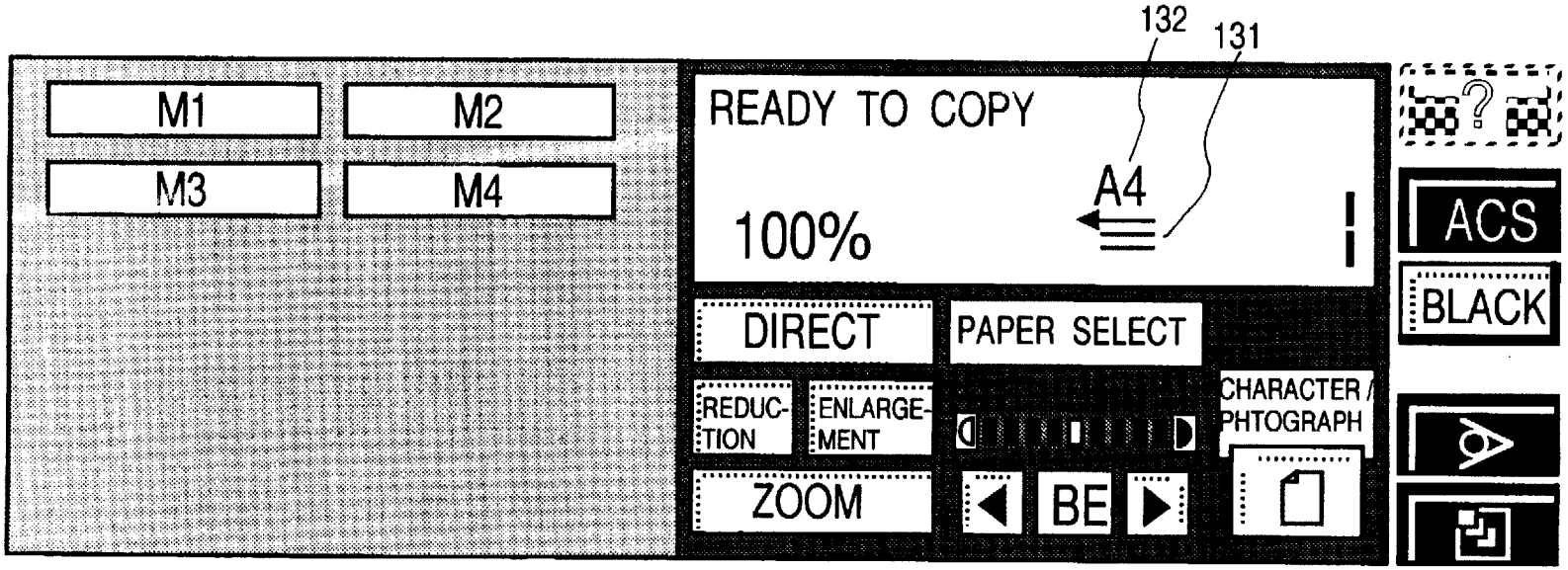
FIG. 7 is a diagram showing a standard picture plane after the manual paper feeding mode was decided.

When a desired regular paper size or other paper size is selected by a key group 127 and an "OK" key 128 is depressed, a "manually select type of stock" picture plane as shown in FIG. 6 is displayed. By selecting a desired type of stock from a plurality of types of stocks by a key group 129 and by depressing an "OK" key 130, a picture plane as shown in FIG. 7 is obtained. A manual paper feeding unit mark 131 and a size 132 are simultaneously displayed.

Since the display contents are changed, information regarding the recording member which is set at present can be known in a setting step. After the setting, those information is concentratedly displayed on the picture plane. Therefore, the operator can more easily and accurately know the information regarding the recording member that is used to form the image than the conventional method.

Figure 5:
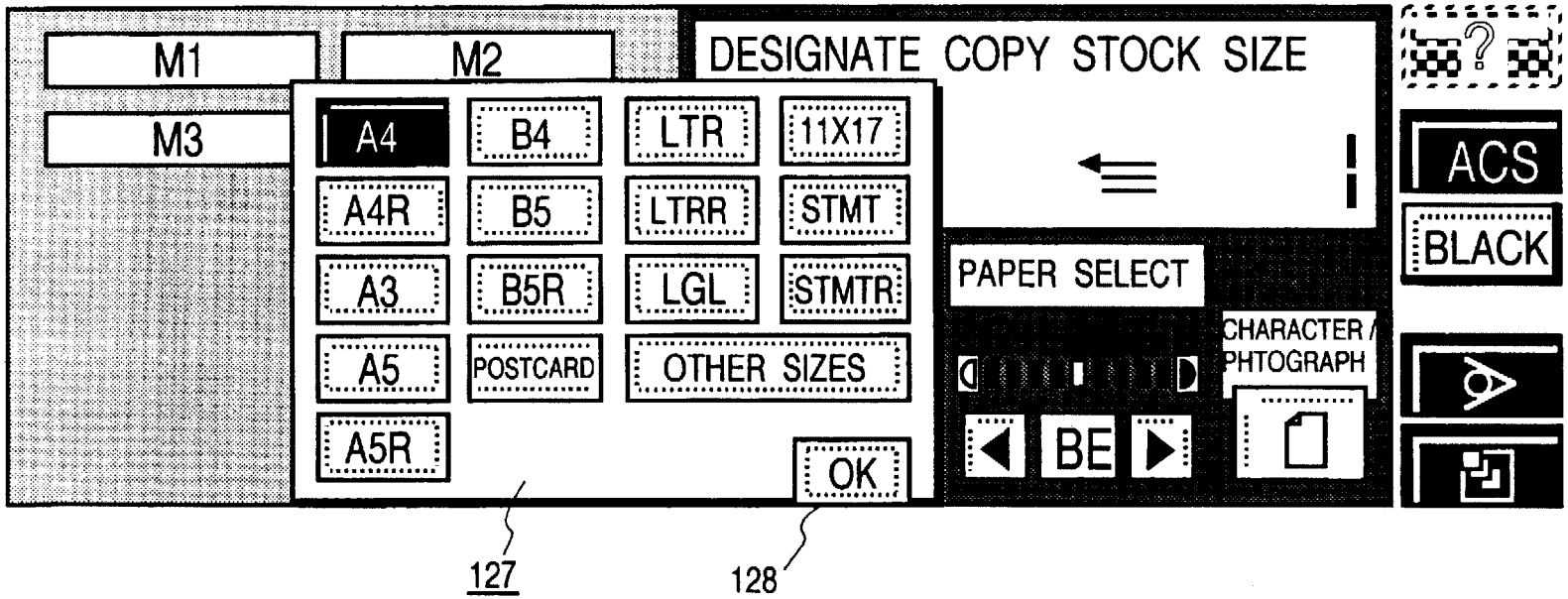
FIG. 5 is a diagram showing a set picture plane after a manual paper feeding mode was selected.

In this instance, the information about the recording member selected on the set picture plane of FIG. 5 has already been transmitted to the printer section. The control section of the printer section controls each section of the printer in a manner such that the printer section forms an image onto the recording member under conditions according to such information, for example, under conditions of a fixing speed, a transfer current of the transfer charging device, and the like.

An embodiment in which the kind (material) of recording members to be enclosed in each cassette is registered will now be described.

Figure 8:
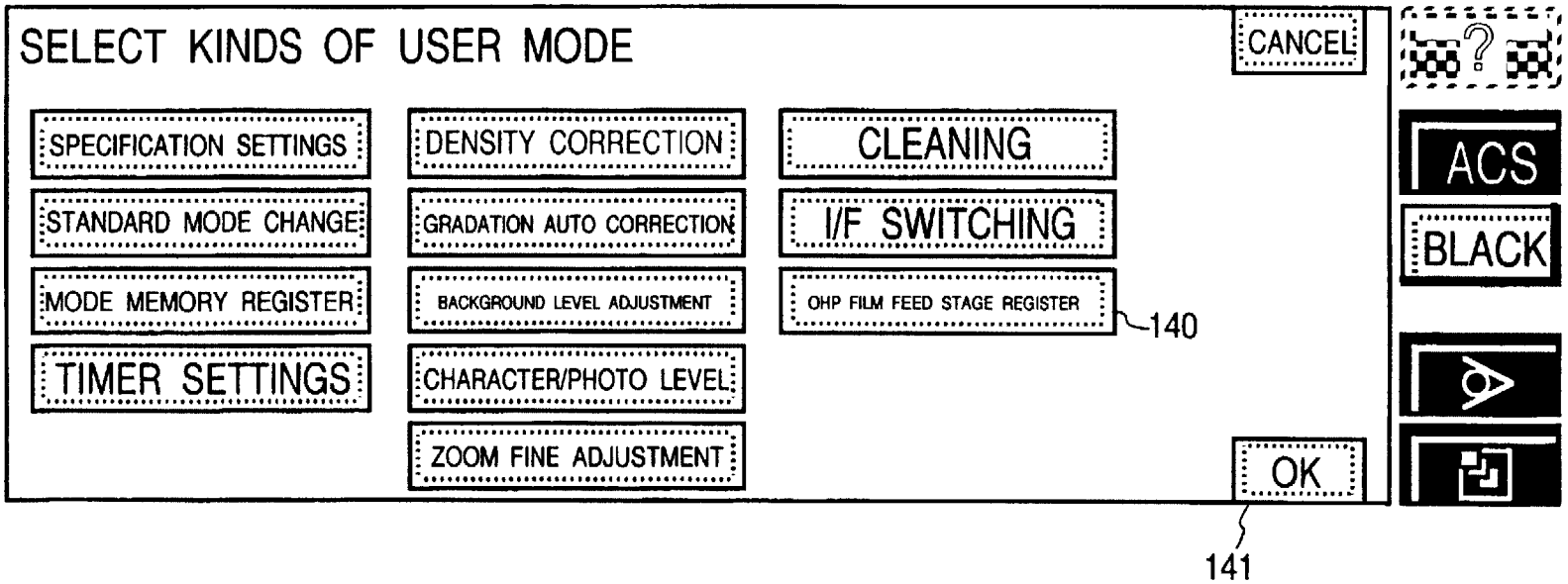
FIG. 8 is a diagram showing a set picture plane of a user mode.
Figure 9:
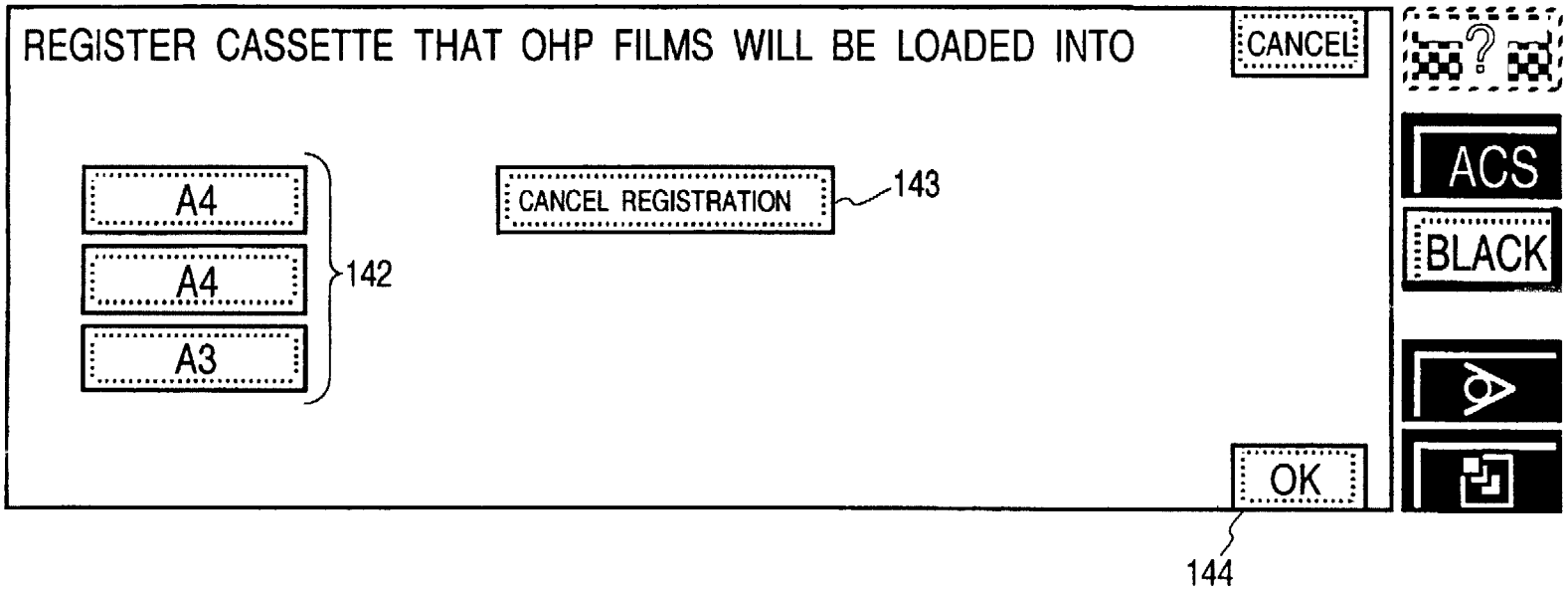
FIG. 9 is a diagram showing a set picture plane of a mode to register a cassette that OHP sheets will be loaded into.

When the operator depresses the user mode key 113 of the operation section, the user mode is set and a set picture plane of FIG. 8 is displayed. When an OHP sheet feed stage registration key 140 is depressed, a set picture plane of FIG. 9 is displayed. When the operator selects the paper feed cassette that the sheets other than the normal copy papers will be loaded into by operating either one of keys 142 on a picture plane shown in FIG. 9, the key corresponding to the selected cassette is inversely displayed. By depressing an "OK" key 144, a fact that the recording member (OHP sheets in this case) of the material other than the normal copy papers have been loaded with respect to the desired paper feed cassette is registered into the RAM 304. After that, the picture plane is returned to the set picture plane of FIG. 8. By depressing an "OK" key 141, the picture plane is returned to the standard picture plane as shown in FIG. 1. When the key 142 corresponding to the paper feed stage in which the kind of recording member has already been registered is depressed and a "cancel registration" key 143 is depressed on the picture plane shown in FIG. 9, such a registration is cancelled. By depressing the "OK" key 144, the picture plane is returned to the set picture plane of FIG. 8.

Figure 10:
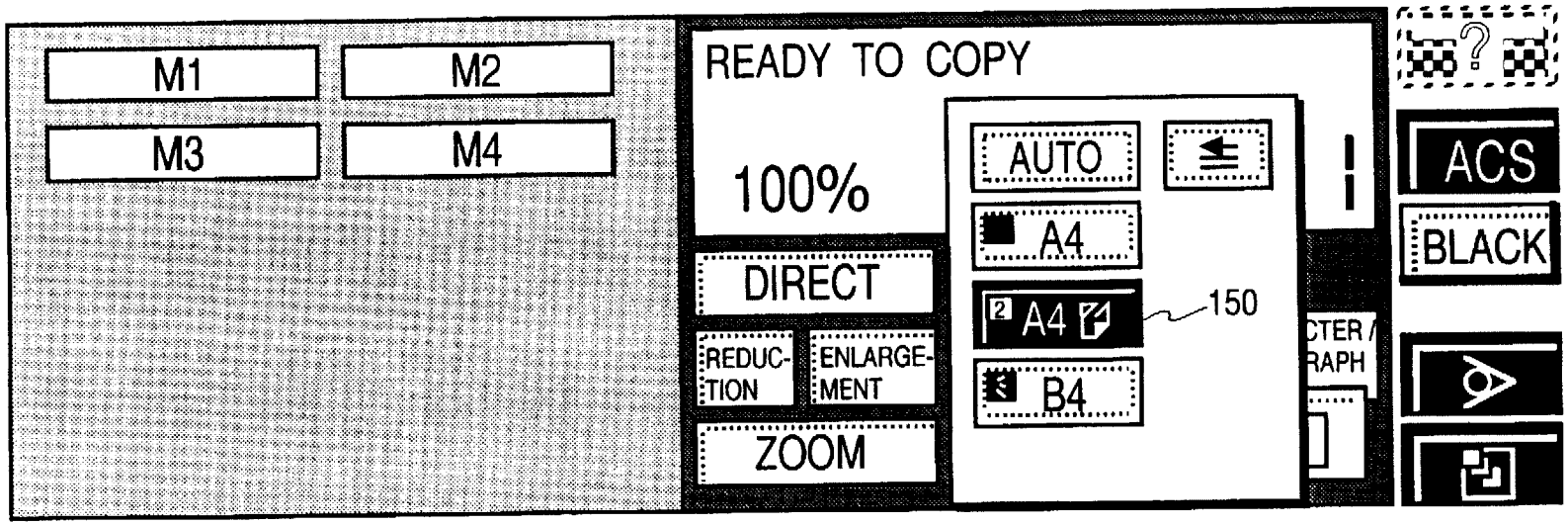
FIG. 10 is a diagram showing a set picture plane after the paper selection key was depressed.

In the case where the user wants to confirm that the recording member of which kind has been prepared in which paper feed stage or the user wants to feed the recording member (OHP sheet in this case) other than the normal copy paper from the cassette, by depressing a "paper selection" key on the standard picture plane of FIG. 1, a picture plane as shown in FIG. 10 is displayed. A fact that the recording members of the material other than the normal copy paper have been enclosed in the cassette of the second stage can be confirmed by checking that a predetermined mark is written to a key 150 to select the cassette of the second stage. Now, it is shown that the second stage was selected. An image can be formed on a desired recording member other than the normal copy paper.

In a manner similar to the case of the manual paper feeding mode, when the cassette which has been registered as a stage in which the OHP sheets were loaded is selected, the image forming conditions according to the OHP sheets are automatically set.

Figure 11:
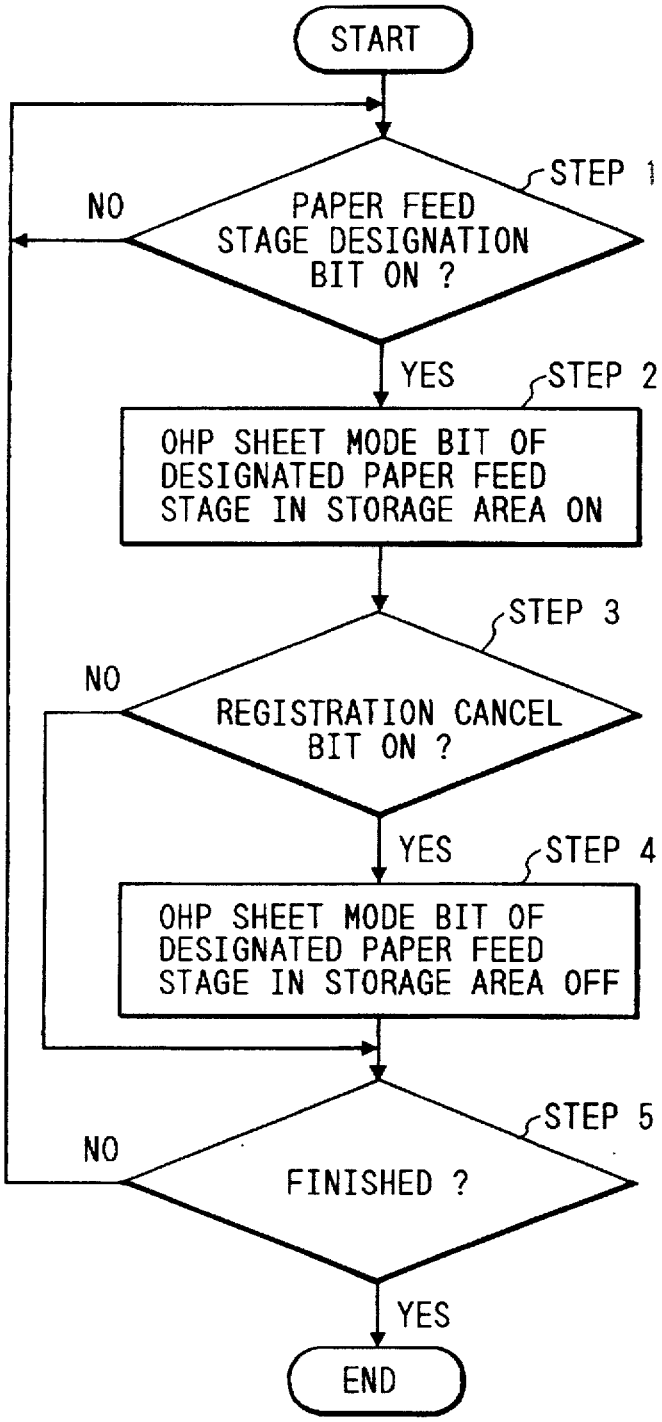
FIG. 11 is a flowchart showing processes in the mode to register a cassette that OHP sheets will be loaded into.

A process for registering the cassette to the OHP sheets will be loaded into will now be described with reference to a flowchart of FIG. 11.

First, when the user mode key 113 is depressed and the OHP sheet feed stage registration key 140 is depressed, the set picture plane of FIG. 9 is displayed. In this state, whether either one of the paper feed stages has been designated by the key 142 or not is judged by checking whether a paper feed stage designation bit corresponding to each paper feed stage in the RAM 304 has been set to ON (1) or not (step 1). If YES, an OHP sheet mode bit corresponding to the designated paper feed stage in the RAM 304 is turned on (1) (step 2). Whether the "cancel registration" key 143 has been depressed or not is judged by checking whether the registration cancel bit in the RAM 304 has been set to ON (1) or not (step 3). If YES, the OHP sheet mode bit of the designated paper feed stage is turned off (0), thereby cancelling the registration of the designated paper feed stage and handling as if the normal copy papers were enclosed in the cassette. When the registration cancel bit is not ON, namely, when the "cancel registration" key 143 is not depressed, it is handled as if the OHP sheets were enclosed in the cassette. A check is made to see if the "OK" key 144 has been depressed or not (step 5). If NO, the apparatus enters a standby mode with the set picture plane held. If the "OK" key 143 was depressed, the picture plane is returned to the set picture plane of FIG. 8.

In case of feeding the OHP sheet from the paper feed cassette which was registered as an OHP sheet feed stage, a monochromatic two-sided copy and a full-color two-sided copy to the recording member are inhibited. It is, consequently, possible to prevent that the images of the front and back surfaces are overlapped and become unsightly. In case of feeding the sheet from the paper feed cassette which is not registered as an OHP sheet feed stage, a two-sided copy can be performed.

Figure 12:
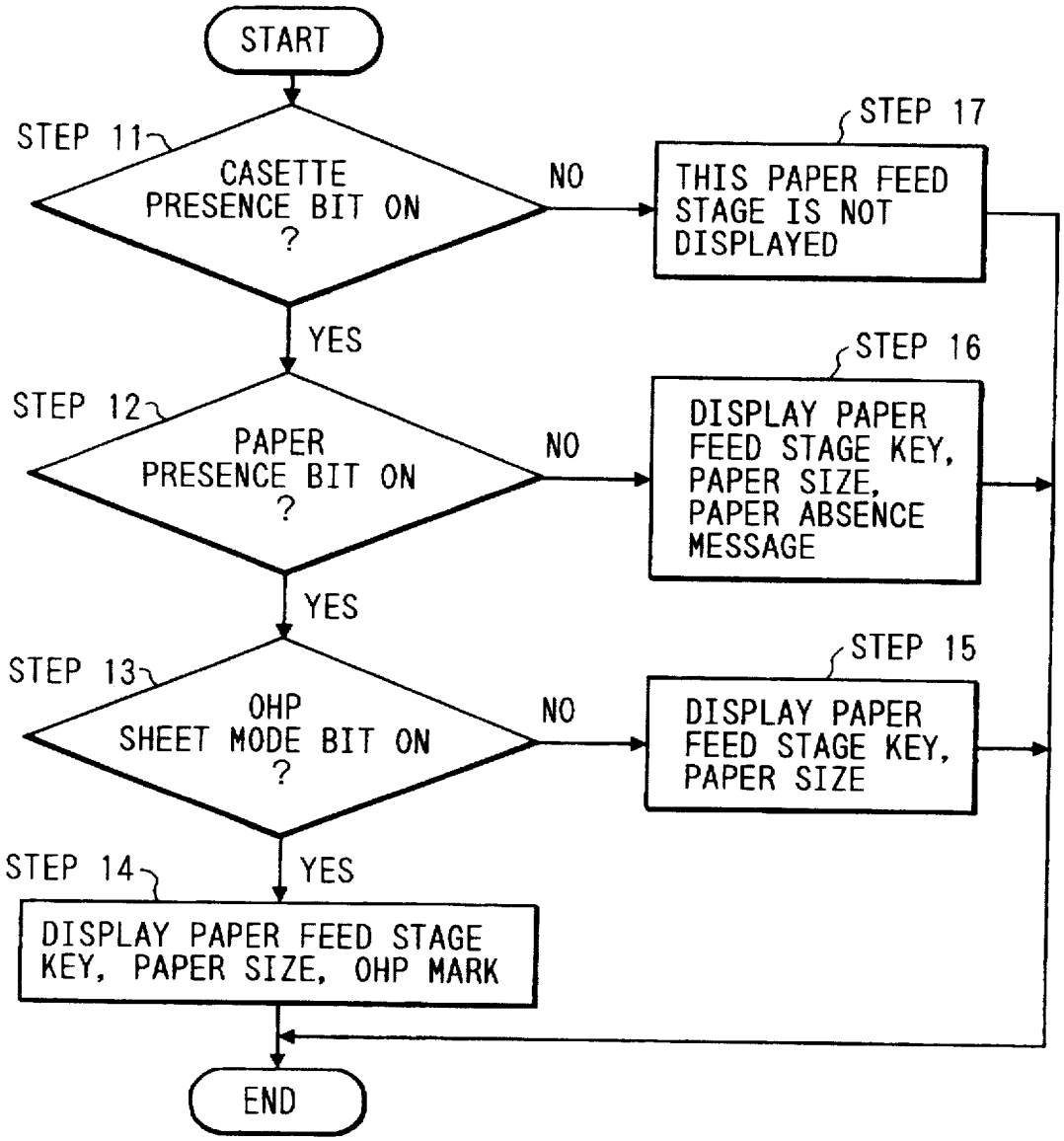
FIG. 12 is a flowchart showing processes for displaying the paper selection key.

A display control of each paper feed stage selection key that is displayed when the paper selection key is depressed will now be described with reference to a flowchart of FIG. 12. A case of one paper feed stage will now be described.

First, a check is made to see if a cassette presence bit corresponding to each paper feed stage in the RAM 304 has been set to ON (1) or not, namely, whether the cassette has been loaded in the apparatus or not (step 11). When the cassette presence bit is OFF (0), the selection key of such a paper feed stage is not displayed (step 17). When the bit is ON, a check is made to see if a paper presence bit has been set to ON or not, namely, there are papers in the cassette or not (step 12). When the paper presence bit is OFF, the selection key is displayed together with the paper size. In this case, however, an outside edge of the key is displayed at a light density (step 16). Namely, by displaying the outside edge of the key at a light density, the absence of paper is shown. When the paper presence bit is ON, a check is made to see if the OHP sheet mode bit is ON or not, namely, whether the OHP sheet feed stage has been registered or not (step 13). When the OHP sheet mode bit is OFF, the selection key is displayed together with the paper size (step 15). When such a bit is ON, the selection key is displayed together with the paper size and the OHP sheet feed stage registration mark (step 14). The above processes are executed with respect to each paper feed stage.

In place of registering the OHP paper feed stage by the input from the operation section, it is also possible to construct in a manner such that a projection or notch indicating that the OHP sheets have been enclosed is formed in a part of the cassette in a manner similar to a projection or notch for size detection and, by inserting the cassette into the copying apparatus, the copying apparatus detects the projection or notch, thereby recognizing that the OHP sheets have been enclosed in the inserted cassette.

Similarly to the manual paper feeding mode, not only the OHP sheets but also the material such as a heavy paper or the like can be also set for the cassette.

The present invention is not limited to the foregoing embodiments but many modifications and variations are possible within the spirit and scope of the appended claims of the invention.

What is claimed is:

1. An image forming apparatus comprising:

mode setting means for setting a manual paper feeding mode for manually feeding a recording member; and material setting means for enabling an input to set a material of the recording member that is manually fed in response to that said manual paper feeding mode was set by said mode setting means.

2. An apparatus according to claim 1, wherein said material setting means automatically sets an input mode for setting the material of the recording member in response to that said manual paper feeding mode was set.

3. An apparatus according to claim 2, wherein said material setting means displays an input picture plane to set the material of the recording member.

4. An apparatus according to claim 1, further having image forming means for forming an image onto the recording member, and wherein said image forming means controls image forming conditions in accordance with the material set by said material setting means.

5. An apparatus according to claim 1, wherein said material setting means sets that the recording member is a transparent sheet.

6. An apparatus according to claim 1, wherein said material setting means sets that the recording member is a heavy sheet.

7. An image forming method comprising the steps of:

a) setting a manual paper feeding mode for manually feeding a recording member; and b) enabling an input to set a material of the recording member that is manually fed in response to that said manual paper feeding mode is set.

8. A method according to claim 7, wherein in said step (b), an input mode to set the material of the recording member is automatically set.

9. A method according to claim 8, wherein in said step (b), an input picture plane to set the material of the recording member is displayed.

10. A method according to claim 7, further including the step of c) controlling image forming conditions in accordance with the material of the set recording member.

11. A method according to claim 7, wherein in said step (b), said recording member is a transparent sheet.

12. A method according to claim 7, wherein in said step (b), said recording member is a heavy sheet.

13. An image forming apparatus comprising:

a plurality of enclosing means for enclosing a plurality of recording members;

material setting means for manually setting a material of the recording member to be enclosed for each of said plurality of enclosing means;

selecting means for selecting an enclosing means in which a recording member of a specific material is enclosed; and cancel means for cancelling a state representing that the material of the recording member to be enclosed has been set by said material setting means for the recording member of a specific material being enclosed, in each of said plurality of enclosing means, wherein said cancel means automatically sets the material of the recording member to a normal material without manually setting the material by said setting means when said state is cancelled.

14. An apparatus according to claim 13, further including:

display means for displaying the enclosing means in which the recording members of a specific material have been enclosed.

15. An apparatus according to claim 13, further including:

image forming means for forming an image onto the recording member, wherein said image forming means controls image forming conditions in accordance with the material of the recording members which are enclosed in the enclosing means selected by said selecting means.

16. An apparatus according to claim 13, wherein said material setting means sets that the recording member is a transparent sheet.

17. An image forming method comprising the steps of:

a) selecting a material setting mode for setting a material of a recording member;

b) selecting enclosing means to enclose recording members of a specific material from among said plurality of enclosing means in the case where said material setting mode is selected;

c) storing data indicating that the recording members of said specific material are enclosed in said enclosing means selected in said step (b); and d) erasing the data stored in said step (c) in the case where plain recording members were enclosed in place of the recording members of said specific material.

18. A method according to claim 17, further including the steps of:

e) selecting one of said plurality of enclosing means in order to form an image; and f) changing image forming conditions in the case where the enclosing means in which the recording members of said specific material have been enclosed is selected in said step (c).

19. An image forming apparatus comprising:

image forming means for forming an image on one or both sides of a recording member;

input means for setting manually a material of the recording member from a console; and control means for inhibiting that the image is formed on both sides of the recording member by said image forming means in the case where it is set manually by said input means that the material of the recording member is a specific material.

20. An apparatus according to claim 19, wherein said detecting means detects that the recording member is a transparent sheet.

* * * * *

UNITED STATES PATENT AND TRADEMARK OFFICE

CERTIFICATE OF CORRECTION

PATENT NO. : 5,717,977
DATED : February 10, 1998
INVENTOR(S) : Akio SUZUKI, et al.

It is certified that error appears in the above-indentified patent and that said Letters Patent is hereby corrected as shown below:

Column 3, line 8, after "made", insert --to--;
Lines 63 and 67, delete "was" and insert therefor --is--.

Column 4, line 2, delete "once" and insert therefor --first--;
Line 4, delete "was" and insert therefor --is--.

Column 5, line 1, delete "those" and insert therefor --this--.

Signed and Sealed this

Thirteenth Day of October 1998

*Attest:*

*Attesting Officer*

BRUCE LEHMAN

*Commissioner of Patents and Trademarks*